US005805177A

United States Patent [19]

Takahashi

[11] Patent Number: 5,805,177

[45] Date of Patent: Sep. 8, 1998

[54] SHEAR MODE DRIVING METHOD FOR AN INK EJECTION DEVICE THAT ACCOMMODATES TEMPERATURE CHANGE

[75] Inventor: Yoshikazu Takahashi, Nagoya, Japan

[73] Assignee: Brother Kogyo Kabushiki Kaisha, Nagoya, Japan

[21] Appl. No.: 705,153

[22] Filed: Aug. 29, 1996

[30] Foreign Application Priority Data

Aug. 29, 1995 [JP] Japan ..... 7-220674

[51] Int. Cl.[6] ..... B41J 29/38

[52] U.S. Cl. ..... 347/11; 347/14

[58] Field of Search ..... 347/11, 14, 68–72

[56] References Cited

U.S. PATENT DOCUMENTS

| | | | |
|---|---|---|---|
| 3,946,398 | 3/1976 | Kyser et al. | 347/68 |
| 4,339,763 | 7/1982 | Kyser et al. | 347/71 |
| 4,368,474 | 1/1983 | Togawa et al. | 347/76 |
| 4,723,129 | 2/1988 | Endo et al. | 347/56 |
| 4,879,568 | 11/1989 | Bartky et al. | 347/69 |
| 5,028,936 | 7/1991 | Bartky et al. | 347/69 |
| 5,159,349 | 10/1992 | Endo et al. | 346/33 A |
| 5,600,349 | 2/1997 | Keefe | 347/11 |

*Primary Examiner*—N. Le
*Assistant Examiner*—C. Dickens
*Attorney, Agent, or Firm*—Oliff & Berridge, PLC

[57] ABSTRACT

A driving method for driving an ink ejection device operated in shear mode. In order to stably eject ink independently of driving frequency and to obtain an excellent print quality regardless of temperature variation, a first drive waveform is used under a critical temperature, e.g., 25° C., and a second drive waveform is used above the critical temperature. The first drive waveform includes a first pulse signal A for ejecting ink from a nozzle and a second pulse signal B for braking the retraction of meniscus. The second pulse signal B is applied to an actuator before the application of the first pulse signal A. A time duration of the first pulse signal A is substantially equal to a predetermined time duration T defined by a time duration for the pressure wave to propagate one end to the other in a lengthwise direction of an ink channel. The second drive waveform includes a third pulse signal C for ejecting ink and a fourth pulse signal D for canceling out pressure fluctuations remaining in the ink after ejection. The time duration of the third pulse signal C is substantially equal to 3 T, and that of the fourth pulse signal D, 1.7 T.

13 Claims, 11 Drawing Sheets

FIG. 6

| Td (XT) / Wb (XT) | 0.3 | | 0.5 | | 1.0 | | 1.5 | | 2.0 | | 2.5 | | 3.0 | |
|---|---|---|---|---|---|---|---|---|---|---|---|---|---|---|
| | SP. | VOL. | SP. | VOL. | SP. | VOL. | SP. | VOL. | SP. | VOL. | SP. | VOL. | SP. | VOL. |
| 0.3 | 5.1 | 43 | 5.1 | 43 | 5.1 | 43 | 5.1 | 43 | 5.0 | 43 | 5.0 | 43 | 5.0 | 43 |
| 0.4 | X | X | X | X | X | X | X | X | X | X | X | X | X | X |
| 0.5 | X | X | X | X | X | X | X | X | X | X | X | X | X | X |
| 0.6 | X | X | X | X | X | X | X | X | X | X | X | X | X | X |
| 0.7 | X | X | X | X | X | X | X | X | X | X | X | X | X | X |
| 0.8 | X | X | X | X | X | X | X | X | X | X | X | X | X | X |
| 1.0 | X | X | X | X | X | X | X | X | X | X | X | X | X | X |
| 1.5 | X | X | X | X | X | X | X | X | X | X | X | X | X | X |
| 1.6 | X | X | X | X | X | X | X | X | X | X | X | X | X | X |
| 1.7 | 5.0 | 45 | 5.0 | 45 | 5.0 | 45 | 5.0 | 45 | 5.0 | 45 | 5.0 | 45 | 5.0 | 45 |
| 1.8 | 5.0 | 45 | 5.0 | 45 | 5.0 | 45 | 5.0 | 45 | 5.0 | 45 | 5.0 | 45 | 5.0 | 45 |
| 2.0 | 5.0 | 45 | 5.0 | 45 | 5.0 | 45 | 5.0 | 45 | 5.0 | 45 | 5.0 | 45 | 5.0 | 45 |
| 2.2 | 5.0 | 45 | 5.0 | 45 | 5.0 | 45 | 5.0 | 45 | 5.0 | 45 | 5.0 | 45 | 5.0 | 45 |
| 2.3 | 5.0 | 45 | 5.0 | 45 | 5.0 | 45 | 5.0 | 45 | 5.0 | 45 | 5.0 | 45 | 5.0 | 45 |
| 2.4 | X | X | X | X | X | X | X | X | X | X | X | X | X | X |
| 2.5 | X | X | X | X | X | X | X | X | X | X | X | X | X | X |
| 3.0 | X | X | X | X | X | X | X | X | X | X | X | X | X | X |
| 3.5 | X | X | X | X | X | X | X | X | X | X | X | X | X | X |
| 3.6 | X | X | X | X | X | X | X | X | X | X | X | X | X | X |
| 3.7 | 5.0 | 46 | 5.0 | 46 | 5.0 | 46 | 5.0 | 46 | 4.9 | 46 | 4.9 | 46 | 4.9 | 46 |
| 3.8 | 5.0 | 46 | 5.0 | 46 | 5.0 | 46 | 5.0 | 46 | 4.9 | 46 | 4.9 | 46 | 4.9 | 46 |
| 4.0 | 5.0 | 46 | 5.0 | 46 | 5.0 | 46 | 5.0 | 46 | 4.9 | 46 | 4.9 | 46 | 4.9 | 46 |
| 4.2 | 5.0 | 46 | 5.0 | 46 | 5.0 | 46 | 5.0 | 46 | 4.9 | 46 | 4.9 | 46 | 4.9 | 46 |
| 4.3 | 5.0 | 46 | 5.0 | 46 | 5.0 | 46 | 5.0 | 46 | 4.9 | 46 | 4.9 | 46 | 4.9 | 46 |
| 4.4 | X | X | X | X | X | X | X | X | X | X | X | X | X | X |
| 4.5 | X | X | X | X | X | X | X | X | X | X | X | X | X | X |
| 5.0 | X | X | X | X | X | X | X | X | X | X | X | X | X | X |
| 5.5 | X | X | X | X | X | X | X | X | X | X | X | X | X | X |
| 5.6 | X | X | X | X | X | X | X | X | X | X | X | X | X | X |
| 5.7 | 4.9 | 47 | 4.9 | 47 | 4.9 | 47 | 4.9 | 47 | 4.8 | 47 | 4.8 | 47 | 4.8 | 47 |
| 5.8 | 4.9 | 47 | 4.9 | 47 | 4.9 | 47 | 4.9 | 47 | 4.8 | 47 | 4.8 | 47 | 4.8 | 47 |
| 6.0 | 4.9 | 47 | 4.9 | 47 | 4.9 | 47 | 4.9 | 47 | 4.8 | 47 | 4.8 | 47 | 4.8 | 47 |
| 6.2 | 4.9 | 47 | 4.9 | 47 | 4.9 | 47 | 4.9 | 47 | 4.8 | 47 | 4.8 | 47 | 4.8 | 47 |
| 6.3 | 4.9 | 47 | 4.9 | 47 | 4.9 | 47 | 4.9 | 47 | 4.8 | 47 | 4.8 | 47 | 4.8 | 47 |
| 6.4 | X | X | X | X | X | X | X | X | X | X | X | X | X | X |
| 6.5 | X | X | X | X | X | X | X | X | X | X | X | X | X | X |
| 7.0 | X | X | X | X | X | X | X | X | X | X | X | X | X | X |
| | m/s | pl | m/s | pl | m/s | pl | m/s | pl | m/s | pl | m/s | pl | m/s | pl |

X : EJECTION BY THE 2ND PULSE SIGNAL

FIG. 7

| Wd(xT) \ d2(xT) | 2.0 | 2.25 | 2.5 | 2.75 | 3.0 |
|---|---|---|---|---|---|
| 0.3 | × | ○ | ○ | ○ | × |
| 0.5 | △ | ○ | ◎ | ○ | △ |
| 0.7 | × | ○ | ○ | ○ | × |
| 1.0 | × | △ | ○ | △ | × |
| 1.3 | △ | ○ | ◎ | ○ | △ |
| 1.5 | △ | ○ | ◎ | ○ | △ |
| 1.7 | △ | ○ | ◎ | ○ | △ |
| 2.0 | × | △ | ○ | △ | × |

◎ SPEED VARIATION : LESS THAN 1.0 m/s
○ SPEED VARIATION : 1.0~2.0 m/s
△ SPEED VARIATION : 2.0~3.0 m/s
× EJECTION DISABLED t = 0 t = T t = 2T t = 3T t = 4T t = 5T t = 6T

SHEAR MODE DRIVING METHOD FOR AN INK EJECTION DEVICE THAT ACCOMMODATES TEMPERATURE CHANGE

BACKGROUND OF THE INVENTION

1. Field of the Invention

The present invention relates to a driving method for an ink ejection device. More particularly, the invention relates to a driving method for driving an actuator so that the volume of an ink channel is increased and after expiration of a predetermined duration of time, the volume of the ink chamber is reverted to thereby eject an ink droplet from the nozzle.

2. Description of the Prior Art

Of non-impact type printing devices which have recently taken the place of conventional impact type printing devices and have greatly propagated in the market, ink-ejecting type printing devices have been known as being operated on the simplest principle and as being effectively used to easily perform multi-gradation and coloration. Of these devices, a drop-on-demand type for ejecting only ink droplets which are used for printing has rapidly propagated because of its excellent ejection efficiency and low running cost.

The drop-on-demand types are representatively known as a Kyser type, as disclosed in U.S. Pat. No. 3,946,398, or as a thermal ejecting type, as disclosed in U.S. Pat. No. 4,723,129. The former, or Kyser type, is difficult to design in a compact size. The latter, the thermal ejecting type, requires the ink to have a heat-resistance property because the ink is heated at a high temperature. Accordingly, these devices have significant problems.

A shear mode type printer, as disclosed in U.S. Pat. No. 4,879,568, has been proposed as a new type to simultaneously solve the above disadvantages.

As shown in FIGS. 8(*a*) and 8(*b*), the shear mode type ink ejection device 600 comprises a bottom wall 601, a ceiling wall 602 and a shear mode actuator wall 603 disposed therebetween. The actuator wall 603 comprises a lower wall 607 which is adhesively attached to the bottom wall 601 and polarized in the direction indicated by an arrow 611, and an upper wall 605 which is adhesively attached to the ceiling wall 602 and polarized in the direction indicated by an arrow 609. An ink channel 613 is formed between two adjacent actuator walls 603. A space 615 is formed between next two adjacent actuator walls 603 so that the space 615, which is narrower than the ink channel 613, is formed next to the ink channel 613. In this manner, the ink channel 613 and the space 615 are alternately formed in the widthwise direction of the bottom wall 601 or the ceiling wall 602.

A nozzle plate 617 is fixedly secured to one ends of the ink channels 613. The nozzle plate 617 is formed with nozzles 618 so as to positionally correspond to the ink channels 613. An electrode 619 is formed in one side of each actuator wall 603 and an electrode 621 is formed in the outer side of the actuator wall 603. A manifold member 628 having a sealing plate 627 is fixedly secured to the other ends of the ink channels 613. The ink channels 613 are in fluid communication with a common ink chamber 626 defined by the manifold member 628. The sealing plate 627 prevents ink from entering the spaces 615 from the common ink chamber 626. Each of the electrodes 619, 621 is formed from a metal. To insulate the metal from the ink, the metal is covered with an insulating material (not shown). The electrodes 621 which face the spaces 615 are connected to ground 623. The electrodes 619 which are provided interiorly of the ink channel 613 are connected to a silicon chip operating as an actuator driving circuit 625.

Next, a manufacturing method for the ink ejection device 600 as described above will be described. First, a piezoelectric ceramic layer, which is polarized in a direction as indicated by an arrow 611, is adhesively attached to the bottom wall 601 and a piezoelectric ceramic layer, which is polarized in a direction as indicated by an arrow 609, is adhesively attached to the ceiling wall 602. The thickness of the piezoelectric ceramic layer to be attached to the bottom wall 601 and the ceiling wall 602 is equal to the height of the lower walls 607 and the upper walls 605. Subsequently, parallel grooves are formed to the piezoelectric ceramic layers using a diamond cutting disc or the like to form the lower walls 607 and the upper walls 605. Then, the electrodes 619 and 621 are deposited on the side surfaces of the lower walls 607 by a vacuum-deposition method, and the insulating layer is deposited onto the electrodes 619 and 621. Likewise, the electrodes 619 and 621 are deposited on the side surfaces of the upper walls 605 and the insulating layer is deposited on the electrodes 619 and 621.

The vertex portions of the upper walls 605 and the lower walls 607 are adhesively attached to one another to form the ink channels 613 and the spaces 615. Next, the nozzle plate 617 formed with the nozzles 618 therein is adhesively attached to one ends of the ink channels 613 and the spaces 615 so that the nozzles 618 positionally correspond to the ink channels 613. The manifold member 628 is adhesively attached to the other ends of ink channels 613 and the spaces 615 so that the sealing plate 627 seals the spaces 615 so as not to allow the ink to enter the spaces 615. The electrodes 619 and 621 are connected to the actuator driving circuit 625 and the ground 623, respectively, through the other end of the ink channels 613 and the spaces 615.

A voltage is applied to the electrodes 619 of each ink channel 613 from the actuator driving circuit 625, whereby the actuator walls 603 defining that ink channel 613 suffer a piezoelectric shear mode deflection in such a direction that the volume of the ink channel 613 increases. For example, as shown in FIG. 9, when a voltage V is applied to the electrodes 619 of the ink channel 613*c*, an electric field is generated in the actuator wall 603*e* in the direction indicated by arrows 631 and 629 and an electric field is generated in the actuator wall 603*f* in the direction indicated by arrows 632 and 630. Because the electric field directions are at right angles to the polarization directions 609 and 611, the actuator walls 603*e* and 603*f* deform outward to increase the volume of the ink channel 613*c* by the piezoelectric shear effect, resulting in a decrease in the pressure in the ink chamber 613*c*. The negative pressure is maintained for a duration of time T corresponding to a duration of time during which time pressure wave propagates one way of the ink channel 613. During the time duration T, ink is supplied from the common ink chamber 626. At this time, the meniscus 24 retracts toward the interior of the ink channel 613*c* as shown in FIG. 10(*b*). The duration of time T is necessary for a pressure wave to propagate across the lengthwise direction of the ink channel.

The duration of time T is given by L/a wherein L is the length of the ink channel 613 and a is the speed of sound through the ink filling channel 613. Theories on pressure wave propagation teach that at the moment the duration of time L/a elapses after the rising edge of voltage, the pressure in the ink channel 613 inverts to a positive pressure. The voltage applied to the electrode 619*c* of the ink channel 613*c* is returned to 0V in synchronization with the timing when the pressure in the ink channel 613 is inverted so that the actuator walls 603*e*, 603*f* revert to their initial shape shown in FIG. 8. The pressure generated when the actuator walls 603*e*, 603*f* return to their initial shape is added to the inverted positive pressure so that a relatively high pressure is generated in the ink channel 613*c*. This relatively high pressure ejects an ink droplet 26 from the nozzle 618*c* as shown in FIGS. 10(*c*) through 10(*g*).

The viscosity of ink used in this type of ink ejection device varies greatly depending on the atmospheric temperature as shown in FIG. 11. In the example shown therein, the viscosity of ink is about 3 mPa·s at 25° C., about 6 mPa·s at 10° C., and about 2 mPa·s at 40° C. Because of the viscosity variation of ink, the speed of the ink droplet is faster at high atmospheric temperature than at low temperature. To minimize the speed variation of the ink droplet caused by the change in the atmospheric temperature, driving voltage of the ink ejection device has been changed depending on the atmospheric temperature.

The above-described driving method of the ink ejection device generates relatively high pressure in the ink filling the ink channel 613*c* at the timing of the ink ejection from the nozzle 618*c*. However, as shown in FIG. 10(*b*), the meniscus 24 is retracted inwardly of the nozzle 618*c* at the time of ink ejection. Therefore, a portion of the relatively high pressure is consumed in pushing the meniscus 24 toward the aperture of the nozzle 618*c*. This wasted portion of the pressure does not contribute to ejection of the ink droplet. The remaining pressure may be insufficient to eject a sufficiently large ink droplet, thereby resulting in poor print quality.

Also, conventionally proposed driving methods of the ink ejection device require a voltage variation circuit or a combination of more than two power sources supplying different voltage level in order to change a driving voltage depending on the atmospheric temperature. The configuration of the driving circuitry is thus costly. In addition to the variation of the ink ejection speed caused by the characteristics of the ink, the low viscosity ink changes the ink ejection speed because the residual pressure fluctuation in the ink channel 613 after the ink ejection is also changed depending on the viscosity of the ink. As a result, the print quality is degraded.

SUMMARY OF THE INVENTION

In view of the foregoing, it is an object of the present invention to provide a driving method for an ink ejection device capable of producing an ink droplet with a volume sufficient for printing.

Another object of the present invention is to provide a driving method for an ink ejection device wherein variation in the ink ejection speed can be eliminated at any atmospheric temperature when the frequency of the driving voltage pulses is changed.

Still another object of the present invention is to provide a driving method for a low-cost ink ejection device wherein an excellent print quality can be obtained.

An ink ejection device to which the present invention is applied includes walls defining an ink channel, the ink channel having a volume filled with ink and having a length defined by two ends; a nozzle plate attached to one end of the ink channel and formed with a nozzle; an actuator for changing the volume of the ink channel; and control means for applying pulse signals to the actuator.

In accordance with the present invention, when atmospheric temperature is under a predetermined value, for example, 25° C., before applying a first pulse signal to the actuator, a second pulse signal is applied thereto. The first pulse signal has a voltage level and a first time duration from a start edge to a termination edge of the first pulse signal. The first time duration is substantially equal to a predetermined time duration T. The second pulse signal has a voltage level equal to the voltage level of the first pulse signal and a second time duration from a start edge to a termination edge of the second pulse signal. The second time duration differs from the first time duration. An ink droplet is not ejected from the nozzle in response to the second pulse signal. The volume of the ink channel is increased from a natural volume to an increased volume, causing to generate a pressure wave in the ink filling the ink channel in response to the start edge of the first pulse signal, and the volume of the ink chamber reverts to the natural volume, thereby ejecting an ink droplet from the nozzle in response to the termination edge of the first pulse signal. The predetermined time duration T is defined by a time duration for the pressure wave to propagate one end to the other in a lengthwise direction of the ink channel.

When atmospheric temperature is above a predetermined value, a third pulse signal is applied to the actuator, and subsequently a fourth pulse signal is applied thereto. The third pulse signal has a voltage level equal to the voltage level of the first pulse signal and a third time duration from a start edge to a termination edge of the third pulse signal. The third time duration is substantially equal to a time duration given by multiplying an odd number equal to or greater than three to the predetermined time duration T. The fourth pulse signal has a voltage level equal to the voltage level of the first pulse signal and a fourth time duration from a start edge to a termination edge of the fourth pulse signal. The fourth duration differs from the third time duration. The volume of the ink channel is increased from the natural volume to the increased volume, causing to generate the pressure wave in the ink filling the ink channel in response to the start edge of the third pulse signal, the volume of the ink chamber reverts to the natural volume, thereby ejecting the ink droplet from the nozzle in response to the termination edge of the third pulse signal, and pressure fluctuations remaining in the ink are canceled out in response to the fourth pulse signal.

It is preferable to set the second time duration equal to a time duration equal to 0.3 T, or in a range from (N−0.3)T to (N+0.3)T where N is an even number equal to or greater than 2.

It is also preferable to pause a time substantially in a range from 0.3 T to 3.0 T from the termination edge of the first pulse signal to the start edge of the second pulse signal.

It is further preferable to pause a time substantially equal to 2.5 times as long as the predetermined time duration T from the termination edge of the third pulse signal to a mid point between the start edge and the termination edge of the fourth pulse signal, and to set the fourth time duration to substantially 0.5 or 1.3 to 1.7 times as long as the predetermined time duration.

BRIEF DESCRIPTION OF THE DRAWINGS

The particular features and advantages of the invention as well as other objects will become more apparent from the following description taken in connection with the accompanying drawings, in which:

FIG. 6 is a table showing experimental results obtained when the width of the second pulse signal and the application timing thereof are changed in the driving method according to the embodiment of the present invention;

FIG. 7 is a table showing experimental results obtained when the width of the fourth pulse signal and the application timing thereof are changed in the driving method according to the embodiment of the present invention;

FIG. 8(*b*) is a plan view showing the ink ejection device shown in FIG. 8(*a*);

DETAILED DESCRIPTION OF THE PREFERRED EMBODIMENTS

Preferred embodiments of the present invention will be described with reference to the accompanying drawings.

Figure 2:
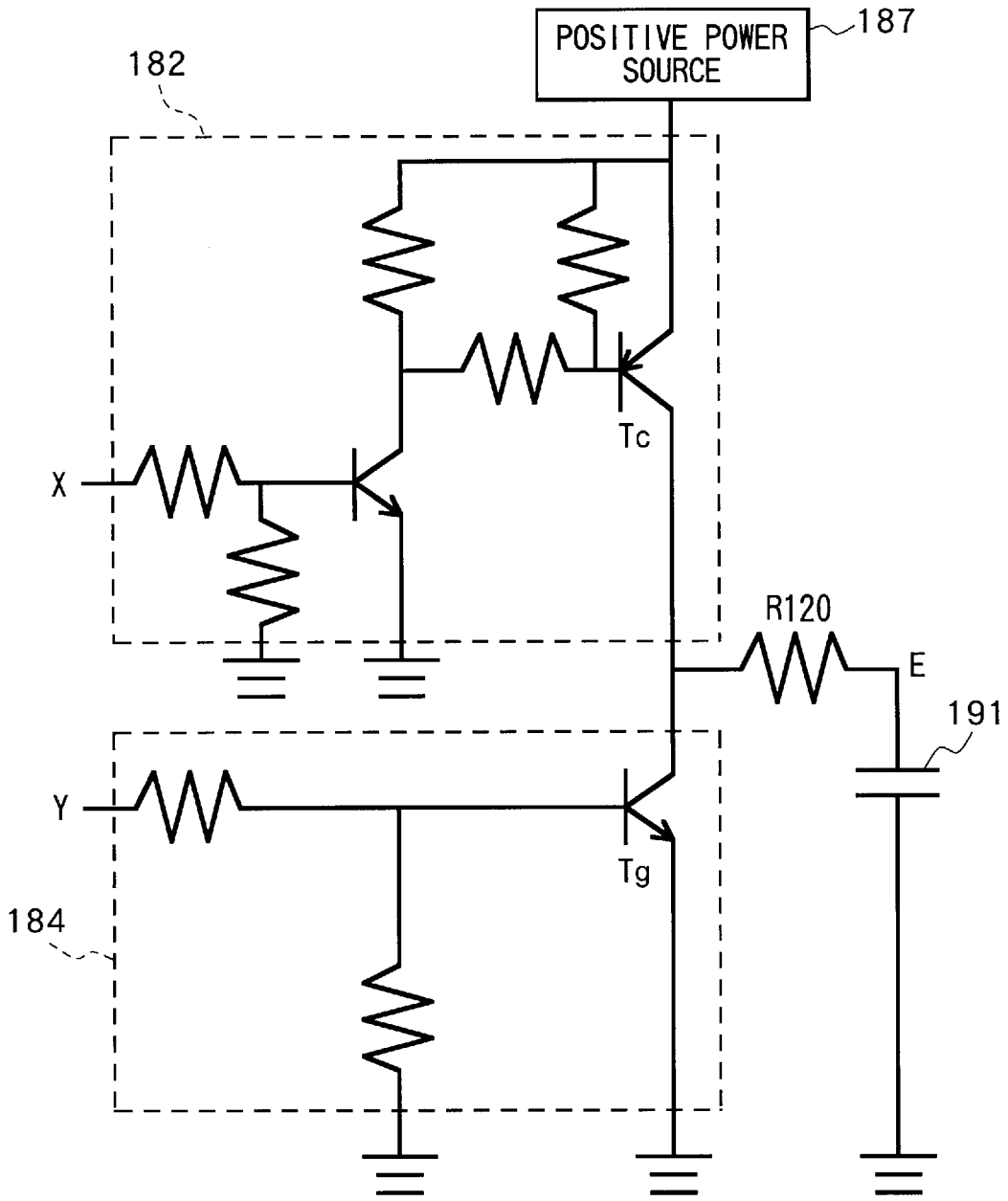
FIG. 2 is a circuit diagram showing a driving circuit for generating the voltage waveforms shown in FIG. 1.
Figure 8:
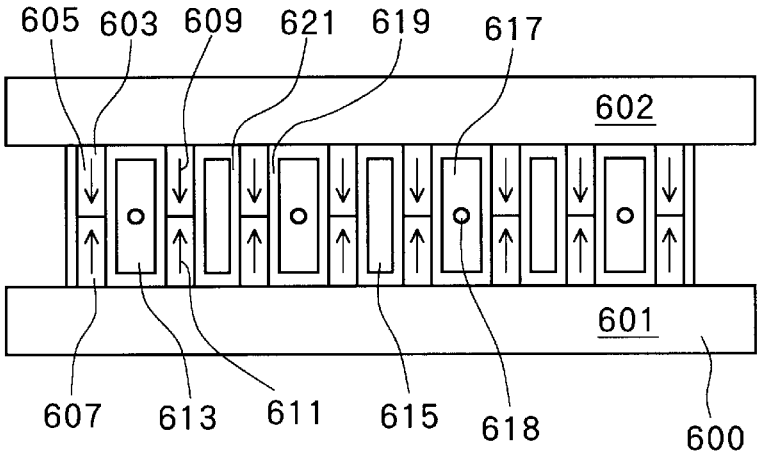
FIG. 8 (a) PRIOR ART
FIG. 8(*a*) is a cross-sectional view showing a conventional ink ejection device, to which the present invention is applied.
Figure 8:
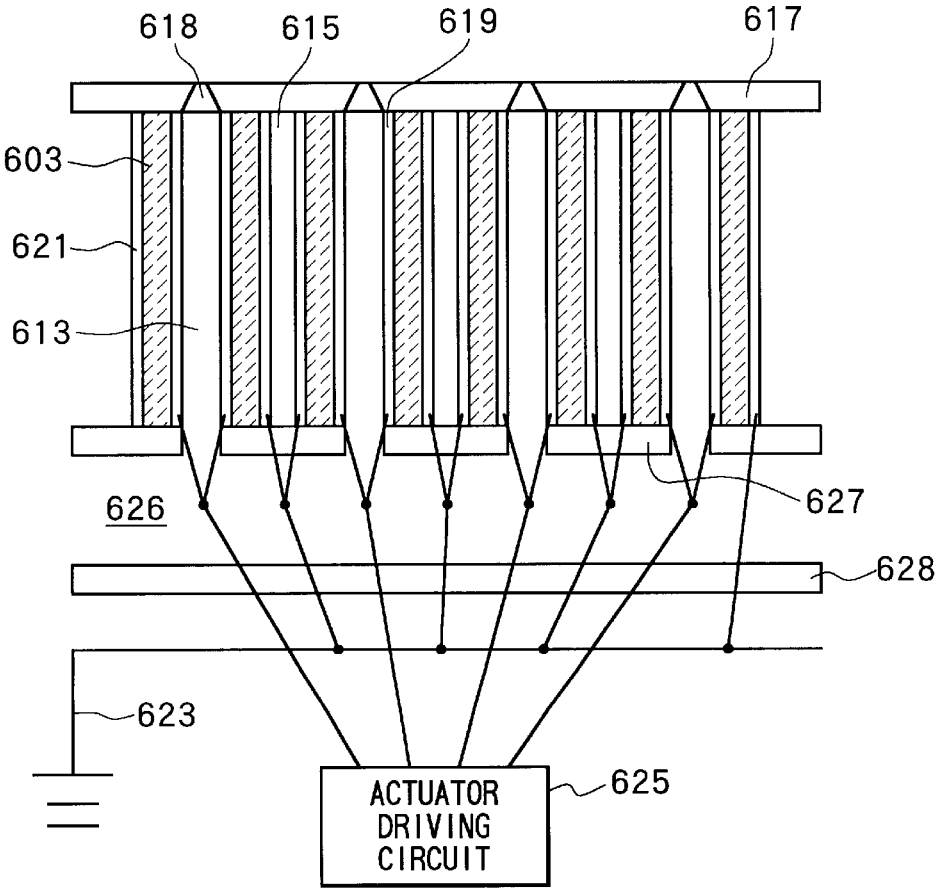
FIG. 8 (b) PRIOR ART
Figure 9:
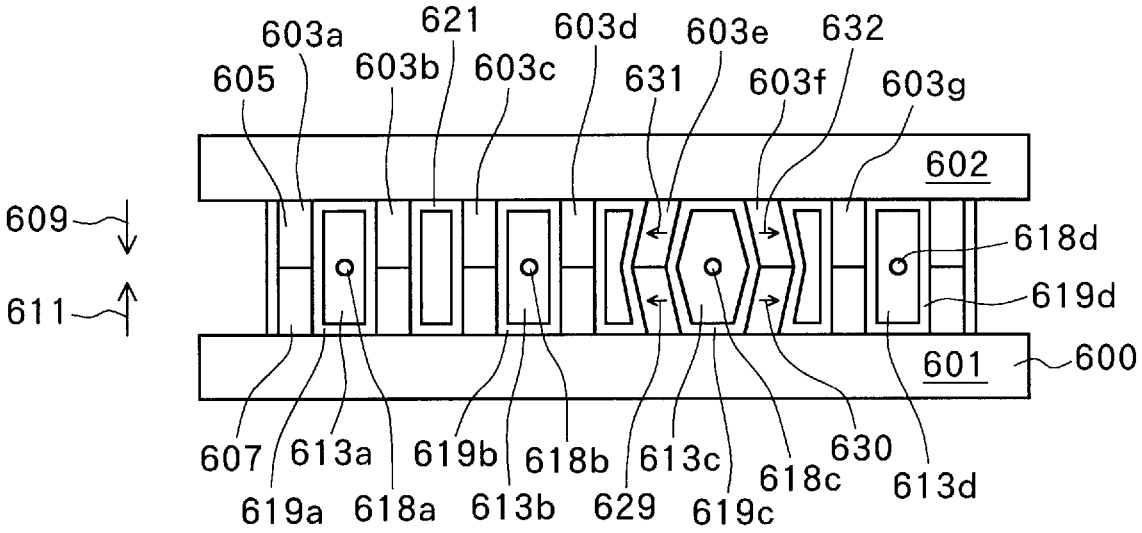
FIG. 9 is a cross-sectional view illustrating an operation of the ink ejection devise shown in FIGS. 8(*a*) and 8(*b*)
Figure 10:
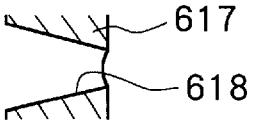
FIGS. 10(*a*) through 10(*g*) are cross-sectional views of ink nozzles illustrating an ink droplet forming process.
Figure 10:
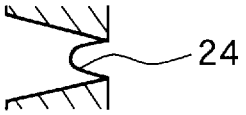
Figure 10:
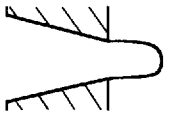
Figure 10:
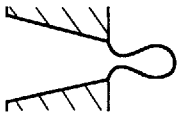
Figure 10:
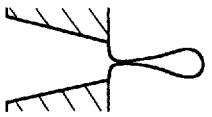
Figure 10:
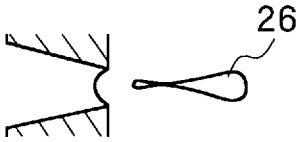
Figure 10:
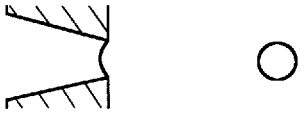

The present invention is applied to an ink ejection device 600 shown in FIGS. 8(*a*) and 8(*b*). Therefore, the description of the ink ejection device 600 will not be repeated here. A circuit arrangement of the actuator driving circuit 625 as used in the embodiment of the present invention is shown in FIG. 2 as will be described later in detail. Although not shown in the drawings, a microcomputer is connected to the actuator driving circuit 625 for applying input signals X and Y to the actuator driving circuit 625 in a prescribed sequential relation.

Figure 11:
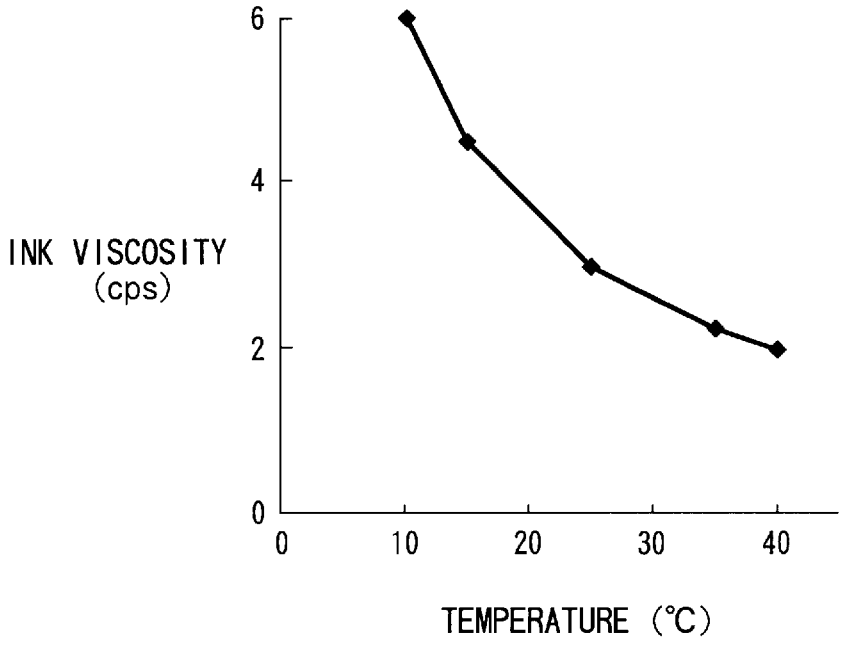
FIG. 11 is a graphical representation illustrating the change in an ink viscosity relative to change in temperature.

Dimensions of the ink ejection device according to the present embodiment will be described. The length L of the ink channel 613 is 7.5 mm. The diameter of the nozzle 618 on the outer side of the nozzle plate 617 is 40 μm, the diameter of the nozzle 618 on the inner side of the nozzle plate 617 is 72 μm, and the length of the nozzle is 100 μm. The ink used in the experiments has a viscosity of 3 mPa·s at 25° C., and the surface tension of 30 mN/m. The change in the ink viscosity depending on the temperature is as shown in FIG. 11. That is, the ink viscosity is 6 mPa·s at 10° C. and 2 mPa·s at 40° C. A ratio of the ink channel length L to the sound velocity a, i.e., L/a, is 12 μsec. The ratio L/a represents a time duration T required for a pressure wave generated in the ink filling the ink channel 613 to propagate one end to the other in a lengthwise direction of the ink channel.

Figure 1:
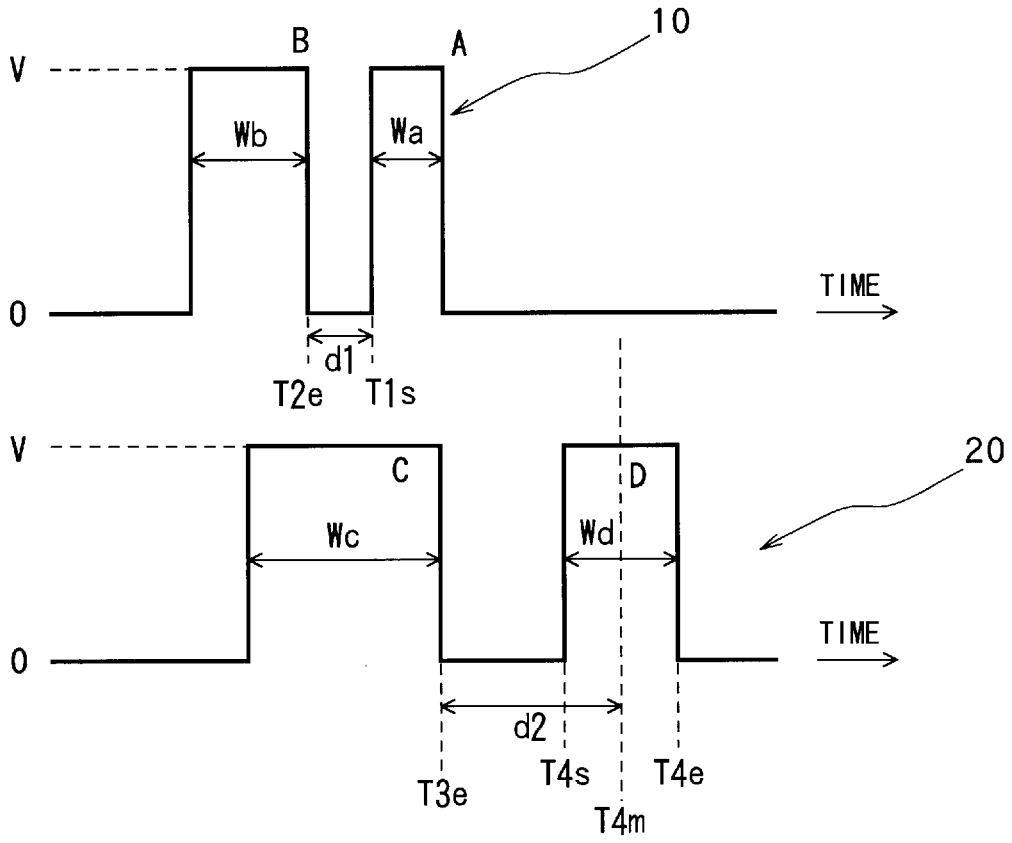
FIG. 1 is a diagram illustrating voltage waveforms for driving an ink ejection device according to an embodiment of the present invention.

FIG. 1 shows two types of driving waveforms to be applied to the electrodes 619 of the ink channel 613. The first driving waveform 10 is used for increasing the ejection speed of a high viscosity ink and also for increasing an amount of ink droplet to be ejected from the nozzle. The second driving waveform 20 is used for decreasing the ejection speed of a low viscosity ink, for minimizing the variation in the ejection speed caused by the variation in the frequency of the driving voltage pulses, and also for increasing the amount of ink droplet to be ejected from the nozzle. The ink ejection device 600 is driven using the first driving waveform 10 in a low temperature circumstance, for example, at a temperature below 25° C. in which the ink is high in viscosity, and the ink ejection device 600 is driven using the second driving waveform 20 in a high temperature circumstance, for example, at a temperature above 25° C. in which the ink is low in viscosity. By selectively using the first and second driving waveforms, a relatively large amount of ink droplet can be ejected from the nozzle and the variation in the ejection speed of ink can be minimized regardless of the change in the atmospheric temperature.

The first driving waveform 10 includes the first pulse signal A and the second pulse signal B. The first pulse signal A is for ejecting ink from the nozzle. The second pulse B is applied before the application of the first pulse signal A in order to prevent the meniscus from retracting inwardly. Both the first pulse signal A and the second pulse signal B have a crest value or a level of V volts (for example, 20 volts). The second pulse signal B has a width or a duration Wb that is two times as long as the time duration T (=L/a). That is, the duration Wb of the second pulse signal B is 24 μsec. The duration of the first pulse signal A is Wa that is equal to the time duration T, i.e., 12 μsec. In FIG. 1, d1 represents the duration of time from the falling edge of the second pulse signal B occurring at timing T2e to the rising edge of the first pulse signal A occurring at timing T1*s*. The duration of time d1 is equal to the time duration T, i.e., d1=12 μsec.

The second waveform 20 includes the third pulse signal C and the forth pulse signal D. The third pulse signal C is for ejecting ink from the nozzle. The fourth pulse signal D is for compensating the residual pressure variation occurring in the ink channel 613 after ejection. Both the third pulse signal C and the forth pulse signal D have a crest value or a level of V volts (for example, 20 volts). The third pulse signal C has a width or a duration Wc that is three times as long as the time duration T. That is, the duration Wc of the third pulse signal C is 36 μsec. The duration of the forth pulse signal D is Wd that is 1.7 times as long as the time duration T, i.e., 20.4 μsec. With the duration Wc of the third pulse signal C set to 3 T, ink droplets are ejected at a lower speed than the ink droplet ejected by the first pulse signal A if the same viscosity ink is used. In FIG. 1, d2 represents the duration of time from the falling edge of the third pulse signal C occurring at timing T3*e* to the midpoint timing T4*m* that is just a center between the rising edge of the forth pulse signal D occurring at timing T4*s* and the falling edge thereof occurring at timing T4*e*. The duration of time d2 is 2.5 times as long as the time duration T, i.e., Wd=30 μsec.

FIG. 2 is a circuit diagram of the actuator driving circuit 625 shown in FIG. 8(*b*), in which a single positive power source 187 is used. The circuit shown in FIG. 2 selectively produces the voltages V and 0 (zero) to be applied to the electrodes 619 of the ink channel 613 in response to input signals X and Y. When the input signal X is rendered ON and the input signal Y is rendered OFF, then the voltage V is applied to a capacitor 191 whereas when the input signal Y is rendered ON and the input signal X is rendered OFF, zero voltage is applied to the capacitor 191. The actuator wall 603 and the electrodes 619 and 621 at both sides thereof form the capacitor 191.

The actuator driving circuit shown in FIG. 2 is formed from two blocks surrounded by broken lines. One block designated by reference numeral 182 indicates a charge circuit for charging the capacitor 191 and another block designated by reference numeral 184 indicates a discharge circuit for discharging the capacitor 191. When the input signal X is rendered ON, a transistor Tc in the charge circuit 182 is rendered conductive, so that the voltage V (for example, 20 V) is applied to the electrode E of the capacitor 191 through a resistor R120 from the positive power source 187. When the input signal Y is rendered ON, a transistor Tg in the discharge circuit 184 is rendered conductive, so that the electrode E of the capacitor 191 is connected to ground through the resistor R120.

Figure 3:
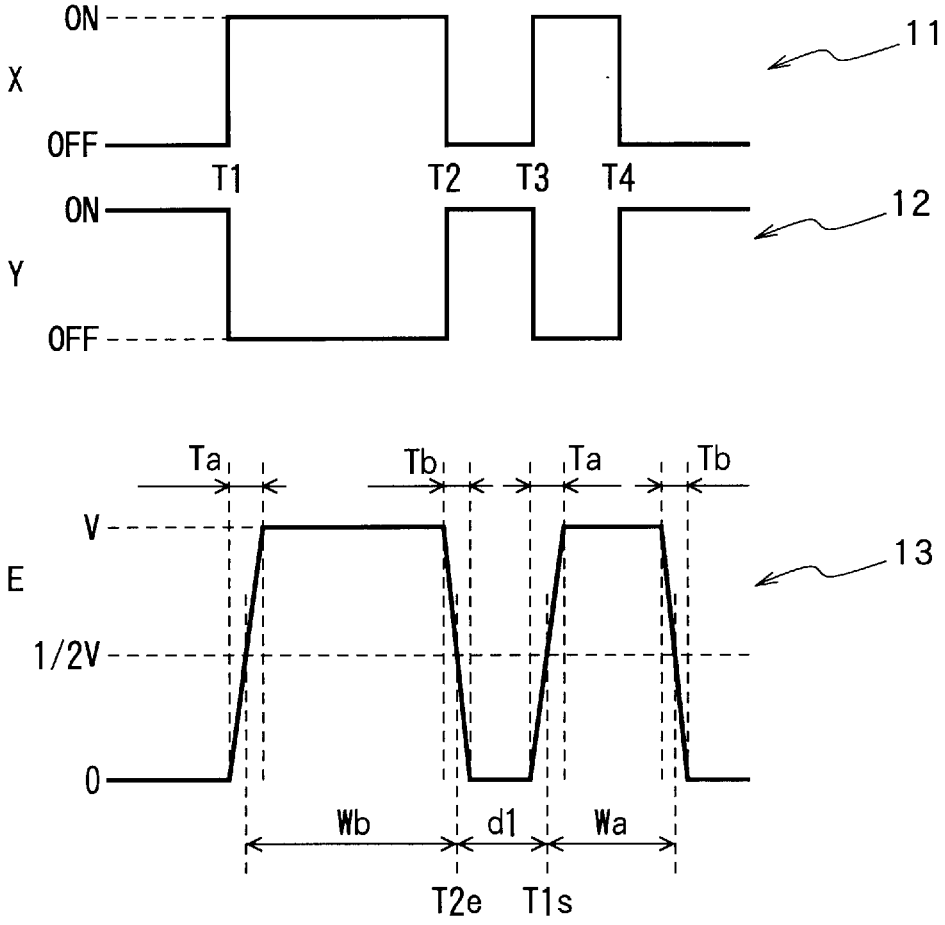
FIG. 3 is a timing chart illustrating a first driving waveform used in driving the ink ejection device according to the embodiment of the present invention.
Figure 4:
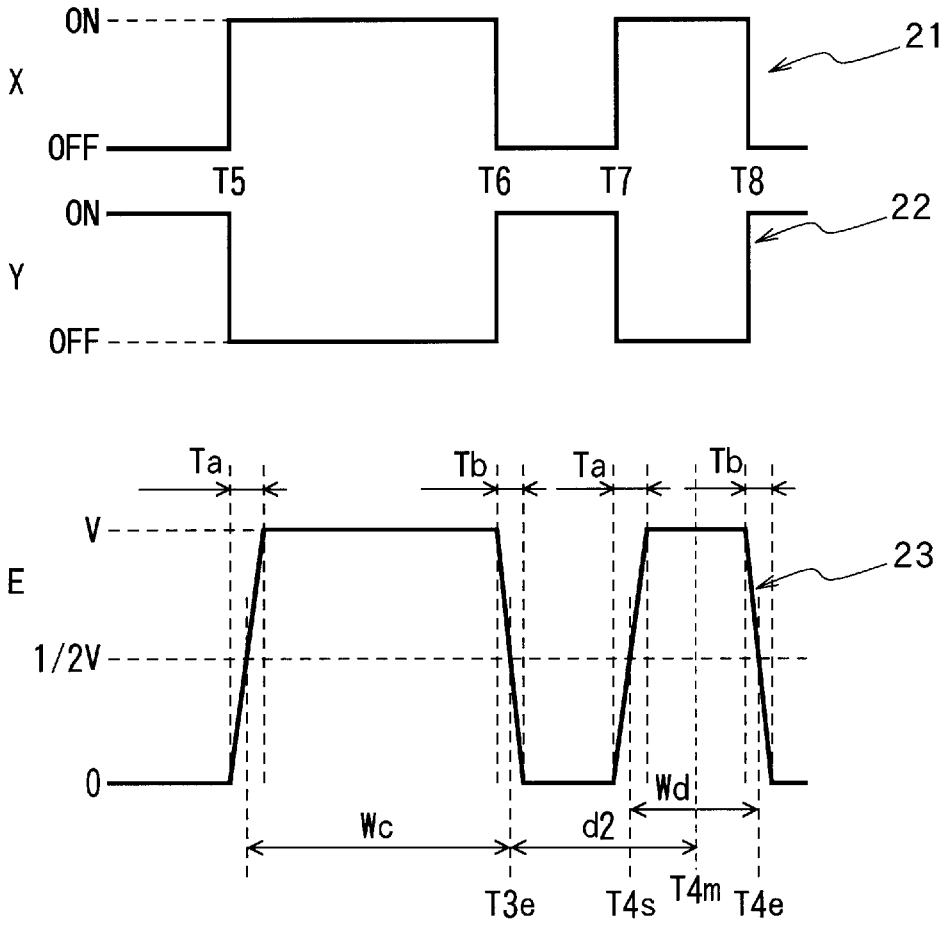
FIG. 4 is a timing chart illustrating a second driving waveform used in driving the ink ejection device according to the embodiment of the present invention.

FIG. 3 shows timing charts 11 and 12 of the input signals X and Y for generating the first driving waveform 10 and also a voltage waveform 13 appearing at the electrode E of the capacitor 191. FIG. 4 shows timing charts 21 and 22 of the input signals X and Y for generating the second driving waveform 20 and also a voltage waveform 23 appearing at the electrode E of the capacitor 191.

As shown in FIGS. 3 and 4, the phase of the input signal X is in an inverse relation to the phase of the input signal Y. These input signals X and Y are supplied from the microcomputer. As shown in FIGS. 3 and 4, the input signal X is normally at a low level (OFF) and is rendered high (ON) at ink ejection timing T1 or T5, and rendered low (OFF) at timing T2 or T6. Thereafter, the input signal X is again rendered high at timing T3 or T7, and rendered low at timing T4 or T8.

The voltage applied to the electrode E of the capacitor 191 is normally at 0 volt but is raised to a voltage V (20 volts) after a charging duration Ta determined by the transistor Tc, the resistor R120 and the capacitor 191. Note that the capacitor 191 start charging at timing T1 or T5. At timing T2 or T6, the charges in the capacitor 191 are discharged and the voltage at the electrode E of the capacitor 191 turns to 0 volt after a discharging duration Tb determined by the transistor Tg, the resistor R120 and the capacitor 191. Subsequently, the capacitor 191 is again charged at timing T3 or T7 so that the voltage at the electrode E is raised to the voltage V (20 volts) after the charging duration Ta. At timing T4 or T8, the charges in the capacitor 191 are discharged so that the voltage applied to the electrode E again turns to 0 volt after the discharging duration Tb.

As described, with the circuit shown in FIG. 2, a time interval Ta is needed for rising up the voltage from 0 volt to V volts and a time interval Tb is needed for falling down the voltage from V volts to 0 volt. Therefore, timings T1 through T4 or T5 through T8 must be determined so that the duration Wa of the first pulse signal A, the duration Wb of the second pulse signal B, a delay time d1 from the falling edge of the second pulse signal B to the rising edge of the first pulse signal A, the duration Wc of the third pulse signal C, the duration Wd of the fourth pulse signal D, and a delay time d2 from the falling edge of the third pulse signal C to the rising edge of the fourth pulse signal D, are equal to the predetermined values as described when measured on the line where the voltage level of the first to fourth pulse signals are V/2 (10 volts).

Ink ejection tests were performed at temperature 25° C. with the driving waveforms as described above. The driving voltage was set to 20 volts. In the test performed with the first driving waveform 10, the ink ejection speed was 6 m/sec and the volume of ink droplet was 45 pl. In the test performed with the second driving waveform 20, the ink ejection speed was 4 m/sec and the volume of ink droplet was 43 pl. To obtain comparative results, the ink ejection device was driven only with the first pulse signal A. In this case, the ink ejection speed was 5 m/sec and the volume of ink droplet was 23 pl. From these test results, it can be appreciated that the volume of ink droplet is increased when the ink ejection device is driven with the first waveform 10 and the second waveform 20.

Figure 5:
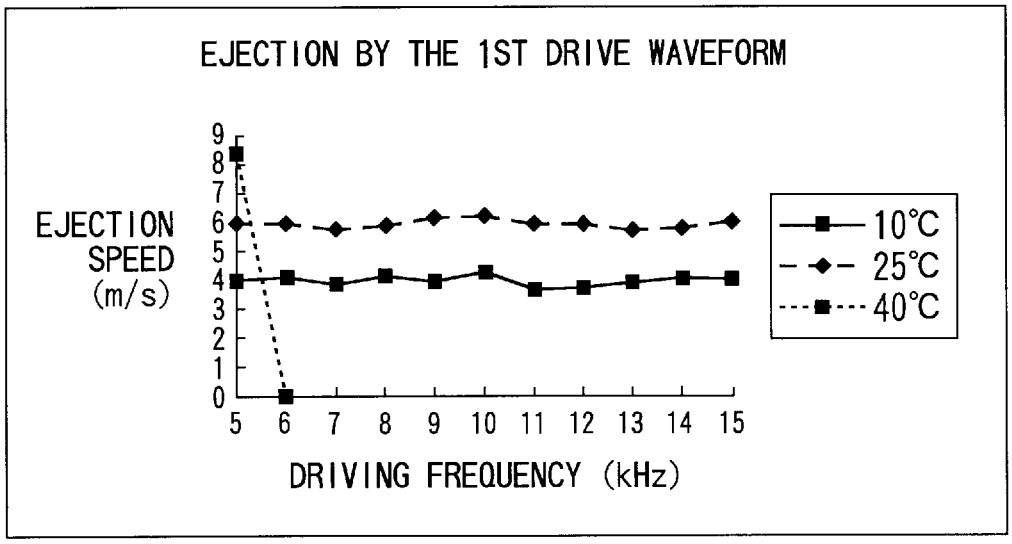
FIGS. 5(*a*) and 5(*b*) are graphical representations illustrating variation in an ejection speed when frequency of driving pulses and temperature are changed according to the embodiment of the present invention.
Figure 5:
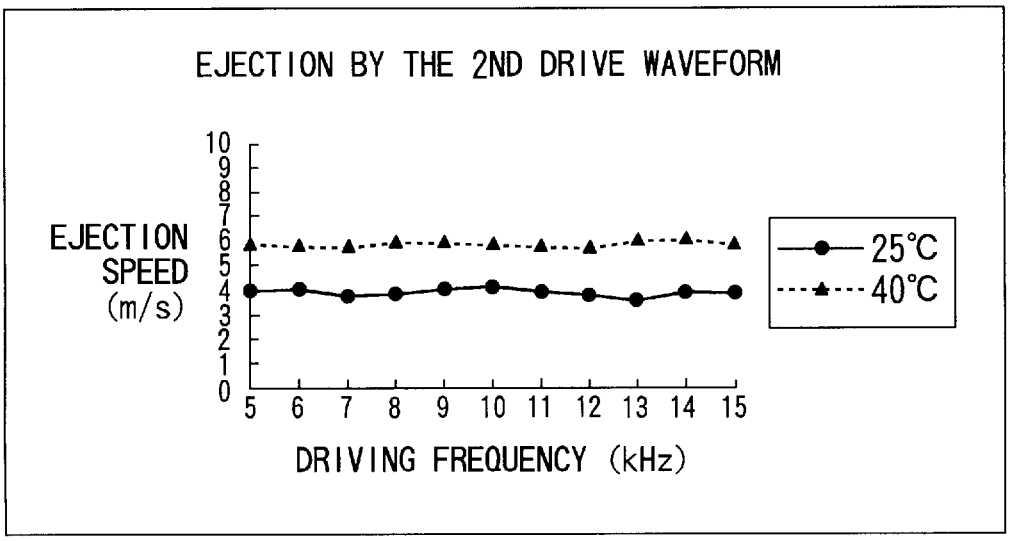

Ink ejection tests were further performed by changing atmospheric temperature and frequency of the driving pulses. The driving voltage was set to 20 volts which ejects ink of 10° C. at a speed of 4 m/sec when driven with the first driving waveform 10 at a very low frequency, for example, 60 Hz. In the tests, the driving frequency was changed from 5 kHz to 15 kHz at temperature of 10° C., 25° C. and 40° C. The test results when driving the ejection device with the first driving waveform 10 are shown in FIG. 5(*a*), and the test results when driving the ejection device with the second driving waveform 20 are shown in FIG. 5(*b*).

When driving with the first driving waveform 10 at temperature 10° C., the ink could stably be ejected at an ink ejection speed of about 4 m/sec regardless of the driving frequency. When driving with the first driving waveform 10 at temperature 25° C., the ink could stably be ejected at an ink ejection speed of about 6 m/sec regardless of the driving frequency. However, at 40° C., ink ejection was disabled when the driving frequency is above 7 kHz. In the tests using the second driving waveform 20, its voltage was also set to 20 volts. At 10° C., the ink ejection was disabled. However, at 25° C., the ink could stably be ejected at an ink ejection speed of about 4 m/sec regardless of the driving frequency. At 40° C., the ink could also stably be ejected at the ink ejection speed of about 6 m/sec regardless of the driving frequency.

It can be appreciated from the test results that by driving the ink ejection device with the first driving waveform 10 at a temperature under 25° C. and with the second driving waveform 20 at a temperature above 25° C., the ink can stably be ejected, yet ejecting a large volume of ink droplet. Specifically, there is no substantial variation in the ejection speed regardless of the temperature and the driving frequency.

In the method of driving the ink ejection device according to this embodiment of the present invention, a single positive power source 187 suffices to produce the first and second pulse signals A and B of the first driving waveform 10 and the third and fourth pulse signals C and D of the second driving waveform 20, because those signals have the same positive voltage level V. Therefore, the circuit configuration used in this embodiment is simpler and less costly than the conventional circuit configurations using a voltage variable circuit or more than two power sources supplying different voltages.

Experimental tests were further performed to investigate optimal range of the width Wb of the second pulse signal B of the first driving waveform 10 and the time delay d1.

FIG. 6 shows evaluation results where the width Wb of the second pulse signal B is changed from 0.3 T to 7.0 T and the delay time d1 is changed from 0.3 T to 3.0 T. The evaluation is performed by observing the ink ejection speed and the ink droplet volume when the ink ejection device is driven at a driving voltage of 20 volts, a driving frequency of 15 kHz, and temperature of 25° C. The evaluation results include X marks indicating that the ink was ejected in response to the second pulse signal.

From the results shown in FIG. 6, it can be appreciated that when the delay time d2 of the second pulse signal B is in the range of 0.3 T to 3.0 T and the width Wb of the second pulse signal B is 0.3 T, from 1.7 T to 2.3 T, from 3.7 T to 4.3 T and from 5.7 T to 6.3 T, there is no ink ejection in response to the second pulse signal B, the variation in the ink ejection speed is small (from 4.8 to 5.1 m/s), and the variation in the volume of ink droplet is also small (43 to 47 pl).

Next, experimental tests were performed to investigate optimal ranges of the width Wd of the forth pulse D of the second driving waveform 20 and time delay d2.

FIG. 7 shows evaluation results where the width Wd of the forth pulse signal D is changed from 0.3 T to 2.0 T and the delay time d2 is changed from 2.0 T to 3.0 T. The evaluation is performed by observing the change of the ink ejection speed while changing the driving frequency from 5 kHz to 15 kHz at temperature of 40° C. The driving voltage is set to 20 V.

In the evaluation of the tests, the double-circle mark indicates that the variation in the speed is less than 1.0 m/sec; the single-circle mark, above 1.0 m/sec; the triangle mark, above 2.0 m/sec but less than 3 m/sec; and the cross mark indicates that the ink ejection is disabled at some frequency. From these results, it can be appreciated that the speed variation of the ink droplet is small if the delay time d2 is 2.5 T and the width Wd of the forth pulse signal D is 0.5 T or in a range from 1.3 T to 1.7 T, whereby ink ejection can be performed stably and hence print quality is excellent.

While an exemplary embodiment of this invention has been described in detail, those skilled in the art will recognize that there are many possible modifications and variations which may be made in the exemplary embodiment while yet retaining many of the novel features and advantages of the invention. For example, although the positive power source 87 is used in the above described embodiment, a negative power source can be used if the polarization directions 609 and 611 of the piezoelectric element shown in FIG. 8(*a*) are inverted.

Further, spaces 615 provided between the ink channels 613 can be dispensed with. In addition, although in the above embodiment, the volume of the ink channel 613 is changed by deforming both the lower part and the upper part of the actuator wall 603, either the upper part or the lower part may deform to this effect.

What is claimed is:

1. A method of driving an ink ejection device that includes:

walls defining an ink channel, the ink channel having a volume filled with ink and having a length defined by two ends;

a nozzle plate attached to one end of the ink channel and formed with a nozzle;

an actuator for changing the volume of the ink channel; and control means for applying pulse signals to the actuator, the method comprising the steps of:

(a) when atmospheric temperature is under a predetermined value, before applying a first pulse signal to the actuator, applying a second pulse signal thereto, wherein the first pulse signal has a voltage level and a first time duration from a start edge to a termination edge of the first pulse signal, the first time duration being substantially equal to a predetermined time duration T, and the second pulse signal has a voltage level equal to the voltage level of the first pulse signal and a second time duration from a start edge to a termination edge of the second pulse signal, the second time duration differing from the first time duration, wherein an ink droplet is not ejected from the nozzle in response to the second pulse signal, the volume of the ink channel is increased from a first volume to an increased volume, causing generation of a pressure wave in the ink filling the ink channel in response to the start edge of the first pulse signal, and the volume of the ink chamber reverts to the first volume, thereby ejecting an in response to the nozzle in response to the termination edge of the first pulse signal, the predetermined time duration T being defined by a length of time for the pressure wave to propagate from one end to the other in a lengthwise direction of the ink channel; and (b) when atmospheric temperature is above a predetermined value, applying a third pulse signal to the actuator, and subsequently applying a fourth pulse signal thereto, wherein the third pulse signal has a voltage level equal to the voltage level of the first pulse signal and a third time duration from a start edge to a termination edge of the third pulse signal, the third time duration being substantially equal to the predetermined time duration T multiplied by an odd number equal to or greater than three, and the fourth pulse signal has a voltage level equal to the voltage level of the first pulse signal and a fourth time duration from a start edge to a termination edge of the fourth pulse signal, the fourth time duration differing from the third time duration, wherein the volume of the ink channel is increased from the first volume to the increased volume, causing generation of the pressure wave in the ink filling the ink channel in response to the start edge of the third pulse signal, the volume of the ink chamber reverts to the first volume, thereby ejecting the ink droplet from the nozzle in response to the termination edge of the third pulse signal, and pressure fluctuations remaining in the ink are canceled out in response to the fourth pulse signal.

2. A method according to claim 1, wherein the second time duration is equal to 0.3 T, or in a range from (N−0.3)T to (N+0.3)T where N is an even number equal to or greater than 2.

3. A method according to claim 1, wherein a delay time from the termination edge of the first pulse signal to the start edge of the second pulse signal is in a range from 0.3 T to 3.0 T.

4. A method according to claim 2, wherein a delay time from the termination edge of the first pulse signal to the start edge of the second pulse signal is in a range from 0.3 T to 3.0 T.

5. A method according to claim 1, wherein a delay time from the termination edge of the third pulse signal to a mid point between the start edge and the termination edge of the fourth pulse signal is substantially equal to 2.5 times as long as the predetermined time duration T, and wherein the fourth time duration is substantially 0.5 or 1.3 to 1.7 times as long as the predetermined time duration.

6. A method according to claim 1, wherein the control means is operable in association with a single power source and supplying the first pulse signal, the second pulse signal, the third pulse signal, and the fourth pulse signal.

7. A method according to claim 1, wherein the second time duration is equal to 0.3 T, or in a range from (N−0.3)T to (N+0.3)T where N is an even number equal to or greater than 2, and wherein a delay time from the termination edge of the third pulse signal to a mid point between the start edge and the termination edge of the fourth pulse signal is substantially equal to 2.5 times as long as the predetermined time duration T, and wherein the fourth time duration is substantially 0.5 or 1.3 to 1.7 times as long as the predetermined time duration.

8. A method according to claim 1, wherein a delay time from the termination edge of the first pulse signal to the start edge of the second pulse signal is in a range from 0.3 T to 3.0 T, wherein a delay time from the termination edge of the third pulse signal to a mid point between the start edge and the termination edge of the fourth pulse signal is substantially equal to 2.5 times as long as the predetermined time duration T, and wherein the fourth time duration is substantially 0.5 or 1.3 to 1.7 times as long as the predetermined time duration.

9. A method according to claim 1, wherein the second time duration is equal to 0.3 T, or in a range from (N−0.3)T to (N+0.3)T where N is an even number equal to or greater than 2, wherein a delay time from the termination edge of the first pulse signal to the start edge of the second pulse signal is in a range from 0.3 T to 3.0T, wherein a delay time from the termination edge of the third pulse signal to a mid point between the start edge and the termination edge of the fourth pulse signal is substantially equal to 2.5 times as long as the predetermined time duration T, and wherein the fourth time duration is substantially 0.5 or 1.3 to 1.7 times as long as the predetermined time duration.

10. A method according to claim 1, wherein steps (a) and (b) are executable at a frequency of 15 kHz.

11. A method according to claim 10, wherein step (b) is executable at a frequency in a range from 5 kHz to 15 kHz.

12. A method according to claim 1, wherein the actuator is in the form of a wall defining the ink channel, at least a portion of the actuator being formed from a piezoelectric material.

13. A method according to claim 12, wherein the piezoelectric material is operated in shear mode.

* * * * *